United States Patent [19]

Labadini et al.

[11] Patent Number: 4,513,227

[45] Date of Patent: Apr. 23, 1985

[54] HIGH INTENSITY DISCHARGE (HID) LAMP STARTING APPARATUS

[75] Inventors: William M. Labadini, Salisbury; John A. Scholz, Danvers, both of Mass.

[73] Assignee: GTE Products Corporation

[21] Appl. No.: 456,679

[22] Filed: Jan. 10, 1983

[51] Int. Cl.[3] ..... H05B 37/00; H05B 39/00; H05B 41/14

[52] U.S. Cl. ..... 315/290; 315/DIG. 7; 315/101; 315/289

[58] Field of Search ..... 315/DIG. 7, 101, 106, 315/105, 109, 289, 290, 194, 60, 65, 205, DIG. 5; 323/222, 223

[56] References Cited

U.S. PATENT DOCUMENTS

| | | | |
|---|---|---|---|
| 3,466,500 | 9/1969 | Peek | 315/289 X |
| 3,679,936 | 7/1972 | Moerkens | 315/289 |
| 4,334,172 | 6/1982 | Wyner et al. | 315/289 |
| 4,347,462 | 8/1982 | Adachi | 315/290 |
| 4,353,011 | 10/1982 | Kaneda | 315/101 |
| 4,355,264 | 10/1982 | Merli | 315/289 |
| 4,360,762 | 11/1982 | Yamamoto et al. | 315/103 |
| 4,399,390 | 8/1983 | Oshita et al. | 315/101 |
| 4,442,380 | 4/1984 | Adachi | 315/290 |
| 4,447,759 | 5/1984 | Moerken et al. | 315/60 |
| 4,488,088 | 12/1984 | Paget | 315/101 |

FOREIGN PATENT DOCUMENTS

| | | | |
|---|---|---|---|
| 54-10584 | 1/1979 | Japan | 315/290 |

*Primary Examiner*—Saxfield Chatmon
*Attorney, Agent, or Firm*—Thomas H. Buffton

[57] ABSTRACT

Apparatus for starting and operating a high intensity discharge lamp includes a pair of terminals connectible to an AC service voltage source and coupled by a ballast to an HID lamp with a series connected gated switch and a non-linear dielectric element shunting the HID lamp, a series connected resistor and capacitor shunting the HID lamp and a bidirectional switch coupling the junction of the resistor and capacitor to the gate electrode of the gated switch whereby a delayed pulse of increased magnitude is applied to an HID lamp.

8 Claims, 2 Drawing Figures

HIGH INTENSITY DISCHARGE (HID) LAMP STARTING APPARATUS

TECHNICAL FIELD

This invention relates to apparatus for starting and operating high intensity discharge (HID) lamps and more particularly to starting and operating apparatus employing a non-linear dielectric element and time delay means.

BACKGROUND ART

Generally, high intensity discharge (HID) lamps require a higher starting voltage than is necessary for starting well-known fluorescent lamps. Also, one of the more popular techniques for activating HID lamps requires a starting element or probe positioned immediately adjacent a quartz arc tube located within a sealed outer envelope of the HID lamp. The arc tube also includes an electrode sealed into opposite ends thereof. An open circuit voltage is applied to the electrodes and to the starting probe causing the gap between the probe ano one of the electrodes to break down and emit electrons which are accelerated by the field between the lamp electrodes initiating a desired discharge between lamp electrodes.

Unfortunately, such techniques require removal of the probe from the active circuit in order to prevent premature lamp failure. Moreover, the end of the lamp having the starting probe therein tends to darken during the starting phase of the lamp which obviously reduces lamp efficiency. Moreover, other known starting schemes for lamps not having starting probes, "penning" gas mixtures and external thermal heating for example, tend to reduce the required starting voltage but unfortunately also adversely affect the lamp efficiency and life.

Additionally, U.S. Pat. No. 3,889,152 of Bodine Jr. et al and U.S. Pat. No. 3,976,910 of Owens et al suggest starting and operating circuitry for HID lamps wherein a transformer arrangement is employed. Therein, the transformer is connected to provide a potential greatly increased over the service potential and delayed by a triggering circuit such that a desired triggering potential occurs at the peak level of the AC voltage. However, transformers are not only undesirably heavy and cumbersome but also add greatly to the apparatus cost.

Further, a copending application bearing U.S. Ser. No. 431,956 filed Sept. 30, 1982 in the names of Stephen G. Johnson and William M. Labadini and assigned to the Assignee of the present application relates to a starting and operating circuit for a fluorescent lamp. Therein, a non-linear dielectric element is employed with a series connected resistor to effect a desired delay in a starting pulse potential. Although a fluorescent lamp having a starting voltage much lower than an HID lamp is employed, the resistor does serve to delay the desired starting pulse. However, the same resistor does expend energy which is very undesirable and also deleterious in so far as efficiency and costs are concerned.

OBJECTS AND SUMMARY OF THE INVENTION

An object of the present invention is to enhance the starting and operation of a high intensity discharge (HID) lamp. Another object of the invention is to improve the operation while reducing apparatus cost of a starting and operating circuit for an HID lamp. Still another object of the invention is to obviate defects associated with prior known HID lamp starting and operating apparatus.

These and other objects, advantages and capabilities are achieved in one aspect of the invention by a high intensity discharge (HID) lamp starting and operating apparatus. A pair of terminals are coupled to an AC source and to an HID lamp by way of an inductive ballast with a series connected resistor and capacitor in parallel connection with a series connected gated switch and non-linear dielectric element both shunting the HID lamp. A bidirectional switch couples the junction of the resistor and capacitor to the gate electrode of the gated switch.

In another aspect of the invention a starting and operating apparatus for HID lamps includes a means for coupling the HID lamp to an AC service voltage source, pulse potential development means including a series connected gated switch and non-linear dielectric element shunting the HID lamp and a timing circuit means including a series connected resistor and capacitor shunting the HID lamp with the junction thereof coupled by a bidirectional switch to the gate electrode of the gated switch.

BEST MODE FOR CARRYING OUT THE INVENTION

For a better understanding of the present invention, together with other ano further objects, advantages and capabilities thereof, reference is made to the following disclosure and appended claims in conjunction with the accompanying drawings.

Figure 1:
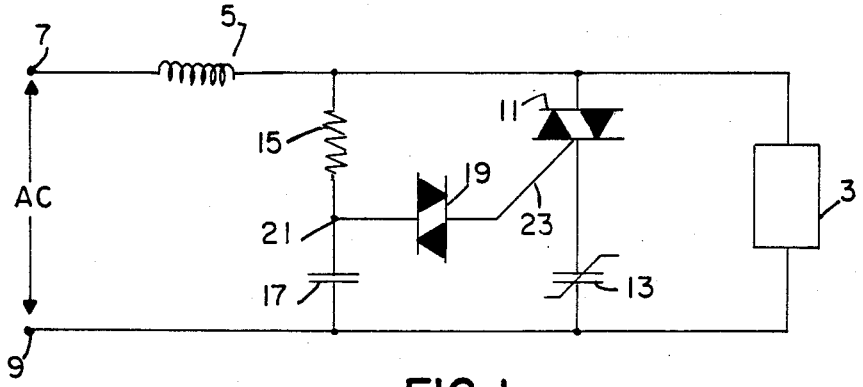
FIG. 1 is a preferred form of the invention.

Referring to the drawings, FIG. 1 illustrates apparatus for starting and operating a high intensity discharge (HID) lamp. Herein, a HID lamp 3 is coupled by way of an inductive ballast 5 to a pair of terminals 7 and 9 connectable to an AC service voltage source. A gated switch 11, such as gated triac for example is in series connection with a non-linear dielectric element 13 such as a barium titanate type non-linear capacitor. This series connected gated switch 11 and non-linear dielectric element 13 is shunteo across the HID lamp 3.

Also, an RC circuit which includes a series connected resistor 15 and capacitor 17 is connected in parallel with the gated switch 11 and dielectric element 13 shunting the HID lamp 3. A bidirectional switch 19, illustrated as a diac in this instance, couples the junction 21 of the series connected resistor 15 and capacitor 17 to the gate electrode 23 of the gated switch 11.

In operation, it is known that HID lamps require a higher starting voltage than the ordinary fluorescent or mercury lamp most commonly employed. Also, it is known and specifically pointed out in the previously-mentioned co-pending application bearing U.S. Ser. No. 431,956 that apparatus employing a non-linear dielectric element may be utilized to start and operate a fluorescent lamp in an efficient manner. However, it has also been found that the above-mentioned potentials available for operating fluorescent apparatus are insufficient for starting and operating HID lamps.

These insufficiencies are overcome by the apparatus of FIG. 1 wherein the potential available from the AC service voltage source provides a current flow which charges the non-linear dielectric element 13 by way of the ballast 5 and gated switch 11. When the non-linear dielectric element 13 reaches full charge, current flow thereto ceases and the inductive field of the ballast 5 collapses producing a high voltage pulse potential which is, in turn, normally applied to the HID lamp 3 in an attempt to initiate conductivity thereof.

However, it was found that the above-described high voltage pulse potential is insufficient to start the HID lamp 3. As a result, initial current flow is passed through the inductor 5 to the resistor 15 to charge the capacitor 17. Once the charge on the capacitor 17 reaches the break-over point of the diac 19, the potential appearing at the junction 21 is applied to the gate electrode 23 of the gated switch 11 to effect conductivity thereof. Thereupon, current flows into the non-linear dielectric element 13 until fully charged whereupon, as previously explained, the inductive field of the ballast 5 collapses providing a high voltage pulse. Moreover, this high voltage pulse is delayed by the RC circuit comprising the resistor 15 and capacitor 17 until such time as a maximum service voltage potential is attained.

Figure 2:
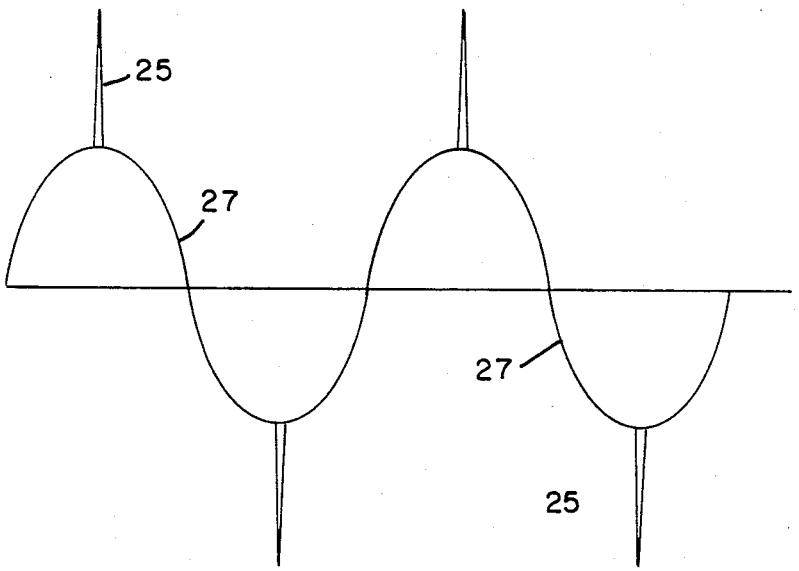
FIG. 2 is a graphic illustration of the operational potential of the embodiment of FIG. 1.

As depicted in the illustration of FIG. 2, a high voltage pulse potential 25 is delayed by the RC circuit until a maximum value of the service voltage 27 is reached. Thereupon, this delayed high voltage pulse potential 25 is at a maximum value and applicable to the HID lamp 3. Thus, a high voltage pulse potential of a value sufficient to start the HID lamp 3 is achieved due to the delay provided by the RC circuit. Moreover, either the resistor 15 or capacitor 17 may be of an adjustable form whereby the time constant of the RC circuit and the time and value of the high voltage pulse potential and consequently the starting of the HID lamp 3 may be controlled.

Once conductivity of the HID lamp 3 has been achieved, the potential appearing at the RC circuit is insufficient to cause charging of the capacitor 17 in an amount sufficient to effect conductivity of the unidirectional switch 19. Thus, the triggering and delaying circuitry is, in effect, disabled once conductivity of the discharge lamp 3 is effected. Moreover, additional non-linear dielectric elements may be parallel connected to the dielectric element 13 to increase the capacity of the dielectric elements of the apparatus.

In a specific example, a ballast member of steel lamination with a 0.010 air gap, 800-turn of No. 28 wire and an inductance of 370 millihenrys was coupled to a 220$^{v}$ AC service voltage source. An 85 watt high pressure sodium lamp was connected to the ballast and service voltage source and an RCA T-2202B type triac and 3.0 nanofarad non-linear capacitor in series connection was shunted across the lamp. Also, a 300 K resistor and 0.005 u f capacitor in series connection were coupled across the lamp while a General Electric diac, type STC-2, coupled the junction of the resistor and capacitor to the gate electrode of the triac or gated switch. As a result, a pulse potential of about 1400-volt was provided for starting the high intensity discharge lamp.

Thus unique apparatus has been provided for starting and operating a high intensity discharge lamp. The apparatus not only provides a relatively high pulse potential but also, more importantly, includes the capability of delaying and thereby increasing the magnitude of the available pulse potential. In this manner, starting of a HID lamp is effected.

While there has been shown and described what is at present considered the preferred embodiments of the invention, it will be obvious to those skilled in the art that various changes and modifications may be made therein without departing from the invention as defined by the appended claims.

What is claimed is:

1. High Intensity Discharge (HID) lamp starting and operating apparatus comprising:

an inductive ballast coupled to a high intensity discharge (HID) lamp;

terminal means coupled to said ballast and to said (HID) lamp and formed for connection to a service voltage source;

timing and triggering circuit means shunting said high intensity discharge (HID) lamp including a series connected resistor and capacitor shunting said lamp, a series connected gated switch and non-linear dielectric element shunting said lamp and a bidirectional switching means coupling the junction of said series connected resistor and capacitor to the gate electrode of said gated switch.

2. The apparatus of claim 1 wherein said non-linear dielectric element is in the form of a non-linear capacitor.

3. The apparatus of claim 1 wherein said non-linear dielectric element is in the form of a barium titanate device.

4. The apparatus of claim 1 wherein said gated switch is in the form of a silicon controlled rectifier and said bidirectional switching means is in the form of a diac.

5. The apparatus of claim 1 wherein said high intensity discharge lamp is in the form of an 85 watt high pressure sodium lamp and said non-linear dielectric element is in the form of a non-linear capacitor having a value of about 3.0 nanofarads.

6. Apparatus for starting and operating a high intensity discharge (HID) lamp comprising:

terminal means formed for connection to a service voltage source;

ballast means coupled to one of said terminal means and to said HID lamp, said lamp coupled to the other one of said terminal means; and timing and triggering circuit means shunting said high intensity discharge (HID) lamp, said circuit means including a series connected gated switch and non-linear capacitor shunting said (HID) lamp, a series connected impedance and capacitance in parallel connection with said series connected gated switch and non-linear capacitor, and a bidirectional switching means coupled to the junction of said series connected impedance and capacitance and to a gate electrode of said gated switch.

7. The apparatus of claim 6 wherein said non-linear capacitor is in the form of a barium titanate device.

8. The apparatus of claim 6 wherein said impedance is in the form of a resistor.

* * * * *